US006464827B1

(12) United States Patent
Colodette

(10) Patent No.: US 6,464,827 B1
(45) Date of Patent: Oct. 15, 2002

(54) METHOD OF DIGESTING WOOD WITH AN ALKALINE LIQUOR BY ADDING AN ACIDIC AGENT TO PRECIPITATE DISSOCIATED LIGNIN

(75) Inventor: Jorge Luiz Colodette, Vicosa (BR)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/722,435

(22) Filed: Nov. 28, 2000

(51) Int. Cl.[7] ..... D21C 3/02; D21C 3/04
(52) U.S. Cl. ..... 162/63; 162/82
(58) Field of Search ..... 162/19, 82, 63, 162/16, 9, 90

(56) References Cited

U.S. PATENT DOCUMENTS

| | | | | | |
|---|---|---|---|---|---|
| 3,874,991 | A | * | 4/1975 | Kleppe | 162/19 |
| 5,002,634 | A | | 3/1991 | Dimmel et al. | 162/72 |
| 5,522,958 | A | | 6/1996 | Li | 162/19 |
| 6,143,130 | A | * | 11/2000 | Stigsson et al. | 162/29 |
| 6,153,052 | A | * | 11/2000 | Luthe et al. | 162/65 |

OTHER PUBLICATIONS

Blain, T.J., "Anthraquinone Pulping: Towards the 21st Century", In: Proceedings of 1998 Tappi Pulping Conference, Montreal, Oct. 25–29, Book 1. pp. 61–93.

Katz, G., et al., "Forecasted value analysis for AQ and AQ/Polysulfide pulping", 1995 Tappi Pulping Conference, pp. 41–52.

Nishijima, H., et al., "Review of polysulfide/anthraquinone pulping to date in Japanese kraft mills and the impact on production", 1995 Tappi Pulping Conference, pp. 31–40.

Thompson, B.A., et al., "Boosting the pulp yield of western softwood with anthraquinone/polysulfide kraft pulping", 1998 Tappi Breaking the Pulp Yield Barrier Symposium Proceedings, pp. 133–143.

Marcoccia, B.S., et al., "Achieving major increases in hardwood yield with Lo–solids® cooking", In: Proceedings of 1998 Tappi breaking the yield barrier symposium, Atlanta, Feb. 17–18. pp. 79–89.

* cited by examiner

*Primary Examiner*—Steve Alvo
(74) *Attorney, Agent, or Firm*—Donald T. Black

(57) ABSTRACT

A method for producing pulp, comprising digesting lignocellulosic wood, containing one or more xylan derivatives selected from the group consisting of xylan bound with lignin, xylan bound with hexenuronic acid, and mixtures thereof, with an aqueous alkaline pulping solution containing sulfide and having an initial free hydroxyl ion concentration of at least 1 mole per liter, under conditions whereunder xylan is dissociated from said one or more xylan derivatives and the pH of the solution remains above 12.5; and then while the pH of said solution is above 12.5, adding a sufficient amount of an acidic agent to said pulping solution to precipitate dissociated xylan from said pulping solution while minimizing precipitation of lignin from said pulping solution. Carbon dioxide is a preferred acidic agent.

8 Claims, No Drawings

METHOD OF DIGESTING WOOD WITH AN ALKALINE LIQUOR BY ADDING AN ACIDIC AGENT TO PRECIPITATE DISSOCIATED LIGNIN

FIELD OF THE INVENTION

The present invention relates to production of pulp useful in the manufacture of paper.

BACKGROUND OF THE INVENTION

Wood represents about 30–45% of total pulp production costs. Thus, increasing the yield of wood conversion into pulp, i.e. the percentage of the wood fed to a pulping operation that usefully becomes part of the pulp solids, is an effective way of achieving the desirable goal of decreasing overall pulp manufacturing costs, by decreasing wood consumption.

Increasing pulp yield provides other benefits such as increased pulp mill through-put and decreased load of black liquor solids to recover. As a consequence there occurs a debottlenecking of the kraft recovery system.

Another important factor in pulp manufacturing costs is the bleaching chemical cost, that can represent 15–20% of the total costs. Total bleach chemical consumption is influenced by the so-called pulp bleachability which is defined as the bleach chemical requirement to achieve a given level of final pulp brightness (e.g. 90% ISO brightness). Thus, increasing pulp bleachabllity during the manufacturing process results in decreased bleach chemical costs.

Those investigating in this field have made many attempts to increase pulp yield and bleachability. Most of the processes proposed are either effective to increase yield or to increase bleachability, but not both at the same time. As a matter of fact, many of the alternate methods proposed to increase pulp yield result in decreased pulp bleachability.

Prior attempts by others with regard to improving yield in the kraft pulp industry can be divided basically into two categories.

One category is processes that use additives together with the wood pulping chemicals to enhance pulping efficiency and to protect pulp carbohydrates. These include: (1) the so-called kraft-anthraquinone pulping whereby anthraquinone (AQ) or any of its derivatives are added together with the pulping chemicals during wood pulping. Besides enhancing the rate of removal from the pulp of the undesirable fractions (lignins) present in the wood, AQ has the property of protecting the desirable fraction (carbohydrates) present in the wood. Anthraquinone acts by oxidation of the carbohydrate reducing end groups, thus increasing overall pulp yield. (2) The so-called kraft-polysulfide pulping whereby polysulfides (PS) are added together with the pulping chemicals to protect the wood carbohydrate fraction. Purportedly, PS have the ability of oxidizing carbohydrate reducing end groups, thus avoiding the so-called "peeling reaction" promoted by the alkali and increasing process yield. (3) The so-called kraft-anthraquinone-polysufide pulping whereby AQ and PS are added together with the wood pulping chemicals. The benefits of these two additives in improving pulp yield have been considered to be synergistic.

It should be noted that the kraft-AO, kraft-PS and kraft-PS-AO processes are effective in improving pulping yield but they have no reported positive effect on pulp bleachability.

In a second category, yield improvements have been based in a more accurate control of kraft pulping kinetics, so that the losses of carbohydrates through peeling reactions and hemicellulose dissolution are minimized. The processes developed for this purpose, the so-called extended delignification processes or modified kraft cooking processes, include among others the isothermal cooking (ITC®), the low solids cooking (Lo-solids®), the extended modified continuous cooking (EMCC®), the rapid displacement heating cooking (RDH®"), and the Super-Batch® cooking processes. The four basic principles that are used more or less extensively in these processes are: (1) a constant temperature profile throughout the cook, (2) a constant alkali profile throughout the cook, (3) a high sulfidity throughout the cook, particularly in the beginning and the end of the cook and (4) a low content of solids in the cooking medium throughout the cook.

It should be noted that all these new processes result in yield improvements in the order of 1–2% at most.

Considering that wood and bleach chemicals have the largest impact on pulp manufacturing costs, and that through-put limitations as well as bottlenecked recovery systems are major problems in modern pulp mills, there remains a need for a method to increase pulp yield and bleachability in the manufacturing process so that overall pulp production cost is decreased.

BRIEF SUMMARY OF THE INVENTION

One aspect of the invention is a method for producing pulp, comprising digesting lignocellulosic wood, containing one or more xylan derivatives selected from the group consisting of xylan bound with lignin, xylan bound with hexenuronic acid, and mixtures thereof, with an aqueous alkaline pulping solution containing sulfide and having an initial free hydroxyl ion concentration of at least 1 mole per liter, under conditions whereunder xylan is dissociated from said one or more xylan derivatives, and the pH of said solution remains above 12.5; and then while the pH of said solution is above 12.5, adding a sufficient amount of an acidic agent to said pulping solution to precipitate dissociated xylan from said pulping solution while minimizing precipitation of lignin from said pulping solution.

DETAILED DESCRIPTION OF THE INVENTION

As used herein, "xylan" and "xylans" means polysaccharides composed of repeating units of the formula:

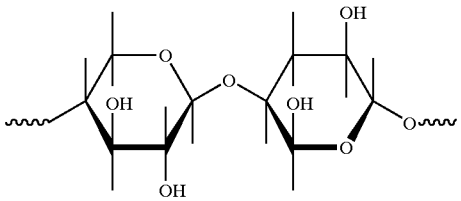

The term "xylan derivatives" means one or more polysaccharides wherein xylan having the aforementioned structure is substituted with one or more substituents and particularly with one or more sugars or with a hexenuronic acid, which is a uronic acid. Examples of xylan derivatives include L-arabino-D-xylans, L-arabino-D-glucurono-D-xylans, L-arabino-(4-O-methyl-D-glucurono)-D-xylans, O-acetyl derivatives of any of the foregoing, xylan bound with lignin, and xylan bound with hexenuronic acid (such as wish hexenuronoxylan or 4-deoxy-β-L-threo-hex-4-enopyranosyluronic acid-xylan).

The term "bound" is used herein to mean that two entities, such as xylan and lignin, are "bound" to each other if they are held together covalently, ionically, by another attractive force, or by being physically engaged with each other such as by intermolecular entanglement. Two entities are considered "bound" if the "bound" form precipitates under conditions under which one of the entities, unbound, would precipitate and one of them, unbound, would not.

Two entities are considered "disassociated" if they are no longer "bound"; thus, disassociation can occur by cleaving of covalent bonds, by neutralizing ionic or other attractive forces, or by disentangling or otherwise disengaging the two entities.

Wood is a complex raw material comprising four major components: cellulose (45–50%), hemicelluloses (15–30%), lignin (20–30%) and extractives (1–5%). The hemicellulose fraction includes two major groups: xylan and xylan derivatives; and glucomannan and glucomannan derivatives. The xylan derivatives are predominant in the hardwoods (about 20%) and are present in appreciable amounts in the softwoods.

Conventionally, the aim of wood pulping is to remove into the pulping liquid the lignin and the extractive fractions while retaining in the solid fraction as much as possible of the carbohydrates (cellulose and hemicelluloses). Nevertheless, during pulping a significant fraction of the carbohydrates are also dissolved into the pulping liquid and their value to the pulp is lost. The lignin, he extractives and a significant fraction of the carbohydrates go into solution and become part of the so-called black liquor. The non-dissolved carbohydrate fraction remains as pulp fibers. Conventionally, about 50% of the wood is dissolved in the black liquor, of which about 25–30% is lignin and extractives and the balance 20% are carbohydrates. In the case of hardwoods, about 10% of the dissolved carbohydrates are xylan and xylan derivatives. The yield of the pulping process is directly related to the amount of cellulose and hemicelluloses that are retained in the pulping operation.

Wood pulping via the conventional kraft process is carried out with a mixture of sodium hydroxide and sodium sulfide at appropriate proportions. This mixture is the so-called white liquor. Both sodium hydroxide and sodium sulfide are effective in removing wood lignin and extractives but sodium hydroxide also dissolves fractions of the cellulose and hemicelluloses. The extent of removal of these wood components affects the yield of the process.

The high alkalinity of pulping solutions is generally understood to contribute to loss of cellulose and hemicelluloses for at least three reasons, which are: (1) solubilization of hemicelluloses due to the high alkalinity of the white liquor; (2) alkali hydrolysis of cellulose and hemicelluloses chains resulting in reduction of their polymerization degree and solubilization of the low molecular weight fragments; and (3) successive elimination of cellulose and hemicellulose chain end units through the "peeling" reaction, which occurs at the reducing end group of cellulose and hemicellulose chains. After one unit is removed a new reducing end unit is created and the process progresses.

Thus, it is all the more unexpected that the process of this invention succeeds even though it employs conditions that are even more highly alkaline and would therefore be expected to lead to even worse losses of pulp yield.

In the process of this invention the wood is digested at a high alkalinity, corresponding to a free hydroxyl ion ($OH^-$) concentration of at least 1 mole per liner and preferably at least 1.25 moles per liter, from the beginning of the "cook" (i.e. the digestion). This high alkalinity (which corresponds to a pH of at least 14) makes the xylan and xylan derivatives soluble in the pulping liquid. Prior art processes in which pulping starts at a lower initial pH than the method of the present invention, necessarily precipitate significant amounts of xylan derivatives such as those containing xylan-lignin and xylan-hexenuronic acid linkages because these substances precipitate from the very beginning, or closer to the beginning, of the digestion. Thus, for a given kappa number, pulps produced the prior way require much higher quantities of chemicals to reach any given brightness degree, i.e., they show poorer bleachability. Xylan-lignin and xylan-hexenuronic acid linkages are hard to oxidize with conventional bleaching chemicals.

If the initial alkalinity corresponds to a free hydroxyl ion concentration of 1 mole per liter or higher, the xylan derivatives remain in solution for sufficient time so that linkages by which a xylan derivative is bound to its substituent (such as xylan-lignin and xylan-hexenuronic acid linkages) are largely hydrolyzed. This hydrolysis is very important to lessen precipitation of xylan derivatives or e.g. lignin and hexenuronic acid into the pulp solids, along with the xylans when the pH is lowered to, or below, the point at which the xylan precipitates.

In this invention, the higher the initial free hydroxyl ion concentration, and the longer the free hydroxyl ion concentration and thus the pH stay high, the longer it takes for the xylan and xylan derivatives to begin to precipitate. Since a key feature of this invention is to start the digestion at a high enough free hydroxyl ion concentration, and to carry out the digestion for a sufficient period of time, that linkages in xylan derivatives such as xylan-lignin and the xylan-hexenuronic acids are cleaved before the pH of the pulping liquid reaches the point at which xylan precipitates, and since as the digestion proceeds the pH of the pulping liquid decreases such that the xylan and xylan derivatives can eventually start to precipitate, it can be helpful to add additional highly alkaline material (such as alkali metal hydroxides and/or sulfides) during the digestion to keep the pH higher, and above the point at which the xylan precipitates, than would otherwise be the case.

The particulars of the kraft cooking process as well as its operational conditions can readily be ascertained and practiced by those skilled in the art. For the purposes of this invention, conventional cooking conditions can be used except for the active alkali which must be higher than usual (at least 20–30% NaOH based on wood weight). Active alkali is defined here as the sum of NaOH and $Na_2S$ concentrations present in the cooking liquor and is expressed as NaOH. Alkalinity is preferably provided by sodium hydroxide or potassium hydroxide. The sulfidity of the cooking liquor and the ratio of pulping liquid to wood can be maintained the same as those used in conventional kraft cooking processes. Thus, in general, a sulfide content of about 15 wt. % to 40 wt. % is effective. Sulfide is preferably provided by sodium sulfide but other compounds can be employed such as polysulfides. A ratio of pulping liquid to wood of about 2:1 to 4:1 (by weight) is effective.

The cooking temperature and the reaction time are adjusted so that the desired pulp kappa number is achieved. Generally, during the digestion a temperature on the order of 155 to 180° C. is effective, as is a residence time on the order of 1 to 6 hours. Because of the high initial active alkali the reaction temperature and/or time must be reduced to maintain the pulp kappa number at the desired target. Ideally one should adjust the reaction temperature to meet the desired kappa number and maintain fixed the reaction time. Kappa number is a non-dimensional value which indicates the total amount of oxidizable material present in the pulp after cooking. It is used as a reference for the bleach plant operation. Chemically, it is defined as the number of milliliters of 0.1 N potassium permanganate solution which is consumed by 1 gram of bone dry pulp according to standard procedures (an example of such standard procedure is Tappi method TAPPI um 245).

The qualities of the wood chips used as feed material, and of the pulping liquid, can be maintained the same as those used in conventional kraft cooking. Also the type of equipment (digester) required to cook the wood need not be changed.

At the end of the pulping cycle, just before the content of cooking digester is emptied out into a blow tank, the pH of the pulping liquid is lowered to cause xylan precipitation and therefore promote yield enhancement. Carbonic gas is preferred to lower the pH because this gas causes no side effects in a pulp mill, as carbonates are already part of the black liquor cycle and formation of additional carbonates in the black liquor do not pose a problem for the black liquor recovery cycle. The most preferred conditions in this step are those which provide selective precipitation of xylans, in which the pH is lowered as nearly as possible to a pH value that results in xylan precipitation but not lignin precipitation. The exact pH value where xylan precipitation selectively (without lignin precipitation) occurs depends on many variables such as temperature, type of wood fiber, xylan content, etc. In general a pH of about 12.5 is effective. However, pH values under 12.4 must be avoided, otherwise lignin precipitation occurs.

The conditions for $CO_2$ application can vary, depending upon the cooking system used. In general, the $CO_2$ should be applied at the same conditions existing in the digester at the end of the cooking cycle. The temperature should be in the range of 110–150° C. and the pressure in the range of 2–8 atm. The amount of $CO_2$ dosed into the reactor will depend on the pH of the pulping liquid and the final pH desired. In general, to reach a final pH of 12.4, the requirement of $CO_2$ will be in the range of 30–40 kg/ton of pulp. The $CO_2$ will be injected at a pressure slightly higher than that existing in the digester at the end of the cooking cycle.

The physical point into which $CO_2$ is injected can be decided in the light of the type of equipment used. In batch reactors (digesters), the $CO_2$ should be injected in the digester blow line. In continuous digesters the $CO_2$ is added to liquors coming from the cooking zone which have high pH values and this liquor is then recycled back to the digester washing zone which contains lower alkali concentration. At this zone which coincides with the end of the cooking cycle the xylans precipitate.

After the acidification of the pulping liquid with $CO_2$ or otherwise to the proper pH value, the contents of the digester are transferred into another vessel such as a blow tank, and the pulp derived from the wood chips is separated out from the black liquor, washed, screened and stored.

This method is carried out prior to any bleaching step, i.e. prior to addition of any compound that provides bleaching or oxidizing conditions in the pulp.

The pulp produced in accordance with this invention can then be bleached. Another major advantage of this process as compared to the prior art is the production of pulp of higher bleachability.

Bleachability is defined as the chemical requirement to bleach the pulp to a given brightness degree. The higher the bleachability of a given pulp the lower the quantity of bleaching chemicals needed to reach a given brightness degree (for example 90% ISO brightness). Due to the low content: of xylan-lignin and xylan-hexenuronic acid derivatives in pulp produced by the present invention, a smaller quantity of bleaching chemicals is required in order to reach a given brightness degree. In the process of this invention, bleaching chemical savings on the order of 10–15% have been shown in relation to a reference.

Without intending to be bound by any particular theory for the efficacy of the present invention, the tendency of xylan derivatives such as xylan-lignin and xylan-hexenuronic acid compounds to impair pulp bleachability is consistent with the proposition that they contain covalent bonds which are difficult to cleave with conventional bleaching chemicals, and the efficacy of the present invention is consistent with the proposition that this problem is overcome by cleavage of these linkages via alkali hydrolysis in solution in the pulping liquid at the higher pH values described herein, whereupon the xylans that precipitate back onto the fibers in the pulp solids are unsubstituted xylans that do not need to be bleached since they are already white.

As compared to the prior art this invention presents the advantages of not requiring the use of any other chemical or enzyme additive to perform the digesting. Also extensive modification of existing cooking equipment is not required to allow for the so-called modified cooking processes (e.g. RDH®, ITC®, Lo-solids®, Super-Batch®, EMCC®, etc.). All that is needed is a point of $CO_2$ injection at the end of the cooking cycle.

Furthermore, the present invention achieves higher yield gains as compared to the prior art, on the order of 3–4%.

The simplicity of the process is apparent from the examples listed below, which are all based on well controlled laboratory experiments performed in duplicate and which were conducted with eucalyptus wood.

EXAMPLE 1

This preliminary laboratory experiment indicated the potential yield benefits derived from the acidification of the reaction media with $CO_2$ at the end of the kraft cooking cycle. One thousand grams of bone dry equivalent wood chips prepared from 7-year old trees were cooked in a laboratory digester under the following conditions: initial pH of 14, 24% active alkali based on wood weight expressed as NaOH, 30% sulfidity based on active alkali, expressed as NaOH, 170° C., 90 min reaction time to reach 170° C., 60-min reaction; time at the 170° C. temperature and liquor:wood ratio of 3:1. At the end of the cooking cycle, the pH of the pulping liquid was 13.39 and the residual alkali about 16.6 g/L as NaOH. At this point, the pulping liquid was washed out and the remaining pulp was analyzed for pulp yield, kappa number and lignin content. Four other cooks were performed under very similar operating conditions and at the end of the cooking cycle, each one of them received a different dose of $CO_2$ so that different final pH values could be obtained. As shown in Table 1, pH values of 13.06, 12.80, 12.30, 11.37 and 10.51 were obtained with different $CO_2$, doses. The yield, kappa number and lignin content of the pulps obtained this way are presented in Table 1. The results show 1.7% yield gain when the pH was reduced from 13.39 to 13.06 without increasing pulp kappa number and lignin content. Dropping the pH even further to a value of 12.80 improved the yield by 2.8% without affecting kappa number and lignin content. This benefit was achieved at the expense of about 27 kg $CO_2$ addition to the reaction medium. Further decreasing the reaction medium pH to 12.30 resulted in additional yield gain but lignin precipitation occurred as can be noted by the increased pulp kappa number and lignin content. The application of this technique to bleachable grade pulp production is limited by lignin precipitation since this additional lignin will drastically affect pulp bleachability. The exact pH value at which $CO_2$ addition should be stopped cannot be drawn from the data presented in Table 1 since the pH points evaluated are not sufficiently close to each other. However, it is obvious that the optimum pH value ranges between 12.80 and 12.30.

TABLE 1

Treatment* of pulp and black liquor with $CO_2$

| pH | $CO_2$ Dose, kg/t pulp | Kappa Number | Yield, % | Lignin % | Yield Without lignin, % | Yield Increase, % |
|---|---|---|---|---|---|---|
| 13.39 | — | 17.6 | 52.7 | 1.901 | 49.8 | 0.0 |
| 13.06 | 17.5 | 17.6 | 53.4 | 1.901 | 51.5 | 1.7 |
| 12.80 | 26.7 | 17.7 | 54.5 | 1.931 | 52.6 | 2.8 |
| 12.30 | 31.5 | 20.1 | 56.4 | 2.714 | 53.7 | 3.9 |
| 12.37 | 35.4 | 20.8 | 55.8 | 2.995 | 52.8 | 3.0 |
| 10.52 | 35.9 | 24.4 | 56.2 | 3.782 | 52.4 | 2.6 |

*65° C., 4% consistency, 10 min.

EXAMPLE 2

The previous example showed the benefits of decreasing final pH of a digestion performed at an alkalinity higher than usual, i.e., ending the digestion cycle at a pH of 13.39. Conventional kraft digestion usually is conducted to final pH values in the range of 11.5–12.5. In order to arrive at more meaningful conclusions the results of digestion under very high alkalinity were compared with those of conventional kraft digestion. In this example, results of conventional kraft digestion conducted to a final pH of 12.45 are compared with those of a digestion effected at high alkalinity (pH 13.41) and with another effected at a high alkalinity with subsequent $CO_2$ acidification to pH 12.46 as taught in the method of this invention. These three pulp samples were submitted to bleachability studies as well (examples 3 and 4). A diagram containing the experimental procedure is shown in FIG. 3, where samples A, B and C are defined. One thousand grams of bone dry equivalent wood chips, prepared from 9-year old eucalyptus trees were digested in a laboratory digester under the following conditions: Initial pH of 14, active alkali of 18% and 24% based on wood weight for the conventional (sample A) and high alkalinity (sample B) digestions, respectively, expressed as NaOH. The reaction time at the temperature of 170° C. were fixed as 145 min and 32 min, for the conventional and high alkalinity digestions, respectively. The other digestion conditions were kept similar for both digestion types, i.e., 30% sulfidity based on active alkali, expressed as NaOH, 90 min reaction time to reach 170° C. temperature, liquor/wood ratio of 3:1. At the end of the cooking cycle, the pH of the reaction media was 12.45 for the conventional digestion (sample A) and 13.41 for the high alkalinity digestion (sample B). The high alkalinity digestion was repeated and at the end of the digestion cycle the pH of the pulping liquid was dropped with $CO_2$ to a value of 12.46 (sample C). All tests were performed in duplicate. Then, the three pulp samples were oxygen delignified (example 3) and bleached with the sequence D(EOP)D under similar bleaching conditions as described in example 4.

The results shown in Table 2 indicate that performing the digestion at high initial pH (sample B) penalizes pulp yield by 2.1% as compared with a conventional digestion (sample A). Also there is a penalty of 17% in pulp viscosity while the pulp brightness is increased by 37%. The yield loss is explained by the high alkalinity used in the digestion which dissolves more wood xylans (Table 3). The viscosity loss is caused by the excessive alkalinity which favors the cleavage of carbohydrate glycosidic bonds, resulting in decreased pulp degree of polymerization and viscosity. On the other hand, the improved brightness derived from digestion at high alkalinity is explained by the minimization of lignin condensation that leads to a pulp residual lignin containing less powerful cromophores of the styrene and stilbene types.

When Sample B was treated according to the process of this invention, i.e., it was acidified with $CO_2$ at the end of he cooking cycle (Sample C) in order to attain a final pHl similar to the one of the conventional digestion, there occurred a yield increase of 1.8% in relation to the reference (Sample A). This yield increase derived from the xylan precipitation caused by the acidification. A proof of that is given in Table 3 where it is seen that the content of xylans of Sample C is about 1.7% higher than that of the reference pulp (Sample A). This alone can explain the increase of 1.8% in overall yield. On the other hand, the content of xylans of Sample B is about 1.9% lower than that of the reference which also explains the lower yield of this sample in relation to the reference.

It should be noted that the acidification step had only a slight effect on pulp viscosity and brightness. In comparing samples A, B and C it is seen that the viscosity penalty increased only about 3% due to the acidification. This is probably explained by the increased amount of xylan in pulp sample C. The brightness gain derived from digestion at high alkalinity dropped slightly after acidification from 37 to 30%.

From the discussions relative to Tables 2 and 3 it is evident that the yield gains obtained according to the method of this invention are mainly caused by the precipitation of unsubstituted xylans effected by the addition of $CO_2$ at the end of the digestion cycle. The mechanism of the xylan precipitation can be explained this way: In order to precipitate a pure xylan it is necessary to solubilize the xylan derivative at the beginning of the digestion cycle with excess alkali and to maintain it in solution for sufficient time that its linkages with lignin and with hexenuronic acids are hydrolyzed by the excess alkali. The xylan produced this way is then precipitated back onto the fibers when the pH is dropped, without increasing pulp lignin content and without penalizing pulp bleachability.

TABLE 2

Treatment* of pulp and black liquor with CO2 in accordance with testing procedure depicted in FIG. 3.

| Sample | Final pH | $CO_2$ Dose, kg/t pulp | Kappa Number | Yield % | Lignin, % | Pulp Viscosity, mPa · s | Pulp Brightness, % ISO | Yield Change, % |
|---|---|---|---|---|---|---|---|---|
| A | 12.47 | — | 16.4 | 53.1 | 1.832 | 52.5 | 25.5 | — |
| A | 12.43 | — | 16.5 | 53.8 | 1.804 | 52.9 | 24.7 | — |
| Avg. | 12.45 | — | 16.5 | 53.4 | 1.818 | 52.7 | 25.1 | Ref |
| B | 13.43 | — | 16.7 | 51.4 | 1.859 | 44.8 | 33.1 | — |
| B | 13.39 | — | 16.6 | 51.3 | 1.786 | 42.1 | 34.3 | — |
| Avg. | 13.41 | — | 16.6 | 51.3 | 1.822 | 43.5 | 33.7 | −2.1 |
| C | 12.47 | 33.8 | 16.9 | 54.5 | 1.887 | 42.8 | 32.2 | — |

TABLE 2-continued

Treatment* of pulp and black liquor with CO2 in accordance with testing procedure depicted in FIG. 3.

| Sample | Final pH | $CO_2$ Dose, kg/t pulp | Kappa Number | Yield % | Lignin, % | Pulp Viscosity, mPa · s | Pulp Brightness, % ISO | Yield Change, % |
|---|---|---|---|---|---|---|---|---|
| C | 12.45 | 32.5 | 16.6 | 55.3 | 1.801 | 40.9 | 33.2 | — |
| Avg. | 12.46 | 33.2 | 16.7 | 54.9 | 1.844 | 41.9 | 32.7 | +1.8 |

65° C., 4% consistency, 10 min.

TABLE 3

Pulp Carbohydrate Composition

| Carbohydrate, % | Sample A | Sample B | Sample C |
|---|---|---|---|
| Glucose | 79.5 | 80.8 | 78.3 |
| Xylose | 13.2 | 11.3 | 14.9 |
| Mannose | 1.3 | 0.8 | 1.4 |
| Galactose | 0.7 | 0.6 | 0.8 |
| Arabinose | 0.4 | 0.5 | 0.4 |
| Rhamnose | 0.5 | 0.3 | 0.4 |
| Total | 95.6 | 95.3 | 96.2 |

EXAMPLES 3 AND 4

One key issue when digesting wood at high alkalinity is the behavior of the resulting pulp in the subsequent bleaching operation, refining and papermaking. Pulps produced at high alkalinity tend to be brighter (Table 2) than conventional ones. Hence, it is anticipated that they will perform better in the subsequent bleaching operation. The three pulp samples generated in example 2 were further bleached by an ECF (elemental chlorine free) bleaching process through the sequence O/OD(EOP)D. The brightness target was 90% ISO. Following the recommendation of the Technical Association of Pulp and Paper Industry (Tappi), as detailed in the Tappi publication TIS 0606-21 entitled "recommended pulp bleaching stage designation method", the O/OD(EOP)D designation represents a sequence which comprises four separate stages, the 0/0 stage first, then a D-stage, then an (EOP) stage and then another D-stage, with a washing step between these stages. In the 0/0 stage the total alkali dose is injected in the first stage and the oxygen dose is split not necessarily evenly between the two O-stages. In the (EOP) stage, alkali, oxygen and hydrogen peroxide are injected in the same stage, apart from each other by fractions of minutes. The conditions used in the various bleaching stages were as follows: 0/0-stage: 10% consistency, (85+95° C.), (30+60 min), 600 kPa pressure, (1.5+0% NaOH) and (1.5+0.5% $O_2$). First D-stage: 10% consistency, 75° C., 60 min, 3.0 final pH and a kappa factor of 0.20; kappa factor is defined as the dosage of chlorine dioxide applied in the stage, expressed as % active chlorine, divided by pulp kappa number. (EOP)stage: 10% consistency, 85° C., (15+75) min, 200 kPa pressure, 10.5 final pH, 1.4% NaOH, 0.5% $O_2$, 0.5% $H_2O_2$), 0.03% Mg. Second D-stage: 10% consistency, 75° C., 240 min, 3.8 final pH and variable amounts of chlorine dioxide depending upon pulp previous treatment and type. The control of pH in the chlorine dioxide bleaching stages was achieved through small additions of NaOH or $H_2SO_4$ together with chlorine dioxide as required.

The results in Table 4 (example 3) show that the oxygen delignification (0/0-stage) performance was not significantly affected by cooking conditions as measured by kappa drop across the 0/0-stage. However, the pulp digested at high alkalinity (sample B) showed 3.8% higher brightness gain across the 0/0-stage indicating that this pulp presents higher bleachability with oxygen than the conventional one (sample A). Furthermore, sample B showed lower viscosity loss across the 0/0-stage which is explained by its lower initial viscosity. When sample B was treated according to the process of this invention to produce sample C, no significant changes were observed in the subsequent oxygen delignification performance. However, the higher brightness gain was maintained indicating that xylan precipitation according to the process of this invention will improve pulp bleachability with oxygen as compared to conventional kraft cooking processes.

TABLE 4

Double-Stage Oxygen Delignification Results (O/(-stage)

| O/O-Stage[1] Results | Sample A | Sample B | Sample C |
|---|---|---|---|
| Kappa In | 16.5 | 16.6 | 16.7 |
| Kappa Drop, % | 40.8 | 39.3 | 39.9 |
| Viscosity Drop, % | 39.9 | 30.3 | 31.6 |
| Brightness Gain, % ISO | 19.5 | 23.3 | 23.8 |
| Yield, % on unbleached pulp | 98.3 | 98.4 | 98.2 |

[1]O/O: 10% consistency, (85 + 95° C.), (30 + 60 min), 600 kPa pressure, (1.5 + 0% NaOH) and (1.5 + 0.5% 02)

The results in Table 5 (Example 4) indicate that the bleachability of the pulp digested at high alkalinity (Sample B) through the sequence O/OD(EOP)D, as measured by the total amount Of $ClO_2$ consumed to reach a final brightness of 90±0.2%, is higher than that of the pulp digested conventionally (sample A). Sample B consumed 16% less chlorine dioxide when bleached with the sequence O/OD (EOP)D. When sample B was treated according to the process of this invention to produce sample C, the benefits of a higher pulp bleachability were almost completely maintained. The total amount of chlorine dioxide was still 14% lower than that of the reference (sample A), indicating that digesting at high alkalinity coupled to $CO_2$ acidification at the end of the cooking cycle result not only in improved yield but also in improved pulp bleachability.

TABLE 5

D(EOP)D bleaching results.

| Pulp Sample | Kappa In | $ClO_2$ Consumption % $D_0$ | $D_1$ | Total | $ClO_2$ Savings (%) | Brightness (% ISO) | Viscosity, mPa · s | Reversion (%) |
|---|---|---|---|---|---|---|---|---|
| A | 9.9 | 0.753 | 0.888 | 1.641 | — | 89.8 | 24.2 | 2.15 |
| A | 9.8 | 0.745 | 0.884 | 1.629 | — | 90.0 | 22.6 | 2.26 |
| Avg. | 9.8 | 0.749 | 0.886 | 1.635 | Ref. | 89.9 | 23.4 | 2.20 |

TABLE 5-continued

D(EOP)D bleaching results.

| Pulp Sample | Kappa In | $ClO_2$ Consumption % $D_0$ | $D_1$ | Total | $ClO_2$ Savings (%) | Brightness (% ISO) | Viscosity, mPa · s | Reversion (%) |
|---|---|---|---|---|---|---|---|---|
| B | 10.0 | 0.760 | 0.597 | 1.357 | — | 89.7 | 20.1 | 2.31 |
| B | 10.1 | 0.768 | 0.613 | 1.381 | — | 90.0 | 18.9 | 2.18 |
| Avg. | 10.1 | 0.764 | 0.605 | 1.369 | 16.3 | 89.8 | 19.5 | 2.24 |
| C | 9.9 | 0.753 | 0.639 | 1.392 | — | 90.1 | 18.3 | 2.15 |
| C | 10.0 | 0.760 | 0.662 | 1.422 | — | 90.0 | 19.1 | 2.28 |
| Avg. | 10.0 | 0.756 | 0.651 | 1.407 | 13.9 | 90.0 | 18.7 | 2.21 |

The improved pulp bleachability is explained based on the fact that pulp samples cooked at high alkalinity (samples B and C) contain less condensed lignin, less xylan-lignin linkages and less xylan-hexenuronic acid linkages in relation to the sample digested conventionally (samole A). The results shown in Table 6 clearly indicate that samples B and C contain less condensed phenolic lignin units and less hexenuronic acids than sample A. The content of lignin-xylan linkages was not measured. However, it is inferred that sample B would have less of this type of linkage because the content of xylans in this sample (Table 3) is much lower than that of the reference pulp (sample A). When sample B is treated according to the method of this invention to generate sample C, a significant amount of xylan is precipitated back onto the fibers. However, this xylan is not linked to lignin or hexenuronic acids. This is evident from the fact that there was no increase in kappa number when xylan was precipitated back through acidification (Table 2). Also the content of hexenuronic acids in the pulp was not changed to any extent after acidification (Table 6).

Overall it can be stated that the increase in pulp bleachability obtained according to the process of this invention is due to the digesting of the wood at high alkalinity, which results in a pulp containing less condensed lignin, less xylan-lignin derivatives and less xylan-hexenuronic acid derivatives.

TABLE 6

Pulp residual lignin characteristics and pulp hexenuronic acid content

| Lignin Functional Groups and Pulp Hexenuronic Acid content | Sample A | Sample B | Sample C |
|---|---|---|---|
| Aliphatic OH, mmol/g lignin | 3.14 | 3.67 | 3.65 |
| Phenolic OH, mmol/g lignin | 2.34 | 2.93 | 2.95 |
| Condensed Phenolic-OH, mmol/g | 0.61 | 0.31 | 0.33 |
| Acid COOH, mmol/g lignin | | | |
| Hexenuronic Acids, mmol/kg | 0.39 | 0.34 | 0.35 |
| pulp | 29.5 | 16.4 | 17.1 |

EXAMPLE 5

As shown in Table 2, there was a significant drop in pulp viscosity when the digestion was performed at high alkalinity (sample B) as compared to the reference (Sample A). The acidification of the reaction media at the end of the digestion cycle according to the method of this invention (Sample C) had no significant impact on pulp viscosity. Thus, the viscosities of samples B and C were similar but significantly lower than that of the reference (sample A). Viscosity gives the average degree of polymerization of the carbohydrate chains and is an indirect measurement of pulp strength. However, the ultimate proof of pulp strength is only obtained through refining of the pulp and direct measurement of its strength properties. Hence, 250-gram samples A, B and C were prepared according to the procedures of Example 2 and bleached according to the procedures of Examples 3 and 4. These samples were refined in a PFI mill at 0, 1000, 2000, 3000 and 4000 revolutions and tested for strength properties according to Tappi standard procedures. The results shown in Table 7, reported at a drainage degree of 40°SR, indicate that the values of pulp tear strength were not substantially affected by the process of this invention. The average values among the samples A, B and C are similar within experimental error. In addition, the values of tensile strength of samples A and C are quite similar. Sample B showed a slightly lower tensile value which is explained by its lower content of xylans. Sample C showed a high tensile index due to its high xylan content derived from xylan precipitation in the acidification step.

An important fact observed in Table 7 is the lower requirement of energy to refine sample C in relation to samples A and B. The fact that sample C had a very high content of xylan, derived from the acidification of the reaction media with $CO_2$, improved pulp refinability. Refinability can be defined as the energy requirement during the refining of a pulp sample to reach a certain drainage degree (e.g., 40°SR). Drainage degree is usually expressed as degree Shopper Riegler (°SR) or Canadian Standard Freeness (CSF). This refinability improvement is easily seen by the lower number of PFI revolutions required to reach a drainage degree of 40° SR. As compared to the reference (sample A) the pulp sample produced according to the method of this invention required 8% less PFI revolutions which can be directly translated into energy. On the other hand, sample B which contained much less xylans required 9% more energy to reach a 40°SR drainage degree in relation to the reference (sample A).

In summary, the method of this invention does not result in any impairment of pulp strength properties while improving pulp refinability. The improvement in pulp refinability is achieved because of the high content of xylans contained in the pulp.

TABLE 7

Pulp Strength Properties and Refinability

| Sample | Tear Index at 40 °SR, mN · $m^2$/g | Tensile Index at 40 °SR, N · m/g | PFI Revolutions to reach 40 °SR |
|---|---|---|---|
| A | 10.0 | 107.3 | 2712 |
| A | 10.3 | 110.3 | 2588 |
| Avg. | 10.2 | 108.8 | 2650 |
| B | 10.8 | 94.7 | 2832 |
| B | 10.9 | 96.6 | 2964 |
| Avg. | 10.8 | 95.6 | 2898 |
| C | 10.5 | 111.4 | 2398 |
| C | 10.0 | 112.8 | 2462 |
| Avg. | 10.3 | 112.1 | 2430 |

The results shown in Tables 2–7 clearly indicate a significant overall yield benefit due to the pulp acidification with $CO_2$ at the end of the cooking cycle. There is also a significant increase in pulp brightness which had a large positive effect on pulp bleachability as shown in Examples 3 and 4. The penalty in pulp viscosity did not translate into any significant pulp strength loss while improving pulp refinability (Example 5). All these benefits were achieved at the expense of a $CO_2$ application of about 33 kg per ton of pulp.

Experimentally, this invention was demonstrated for eucalyptus wood. However it is applicable to any type of wood that contains significant amounts of xylans or xylan derivatives. These may include any wood species of the hardwood (angiosperm) and softwood (gymnosperm) classes.

The process was developed for kraft cooking. However it is also applicable to any type of alkaline cooking that ends at a pH above 12.5. This may include the soda, soda/Anthraquinone (AQ), soda-polysulfide (PS), soda-AQ-PS, kraft-AQ, kraft-PS and kraft-AQ-PS pulping processes. It is also applicable to any of the kinetically modified cooking processes (ITC®, RDH®, Lo-solids®, Super-Batch®, Ennerbatch®, EMCC®), etc.

The examples given were for wood pulping at the temperature of 170° C., liquor:wood ratio of 3:1, active alkali of 24% and sulfidity of 30%. However, other operational conditions can be used depending on the type of wood. These may include temperatures in the range of 140–180° C., times at temperature of 30–180 min, liquor:wood ratios of 5:1 to 2:1, final cooking pH from 12.5–14 and sulfidity from 5–40%.

The examples are given for pulp samples of kappa number around 17–18 but the technique is also applicable for pulps of kappa number ranging from 12 to 45.

The acidification step should preferably be done with $CO_2$ because this acid is more adapted to the cooking cycle. It will result in the formation of sodium and calcium carbonates which are common chemicals existing in the cooking and recovery cycle. However, other mineral acids compatible with the recovery cycle could be used. Also, low alkalinity streams extracted from the digester itself could be used to lower the pH of the pulping liquid.

The physical point of $CO_2$ injection into the cooking cycle can be in the bottom of the digester or in the blow fine. However other points of injection along the digester body or in the liquor circulation streams are also possible.

The purity of the $CO_2$ used to acidify the reaction media may vary from 70–100%. When lower purity $CO_2$ is to be used the impurities should be compatible with the recovery cycle. The impure $CO_2$ should not contain substances other than oxygen, nitrogen, argon, and sulfur compounds. Particulate material can cause problems in the injection and control equipment and should be absent.

What is claimed is:

1. A method for producing a mixture of wood pulp in pulping solution, comprising digesting lignocellulosic wood, containing one or more xylan derivatives selected from the group consisting of xylan bound with lignin, xylan bound with hexenuronic acid, and mixtures thereof, with an aqueous alkaline pulping solution containing sulfide and having an initial free hydroxyl ion concentration of at least 1 mole per liter, under conditions whereunder xylan is dissociated from said one or more xylan derivatives, and the pH of The solution remains above 12.5; and then while the pH of said solution is above 12.5, adding a sufficient amount of an acidic agent to said pulping solution to precipitate dissociated xylan from said pulping solution while minimizing precipitation of lignin from said pulping solution.

2. A method according to claim 1 wherein alkali is added to the alkaline pulping solution during said digestion.

3. A method according to claim 1 wherein said alkaline pulping solution is a solution of sodium hydroxide and sodium sulfide.

4. A method according to claim 1 wherein the initial free hydroxyl ion concentration of said pulping solution is at least 1.25 moles per liter.

5. A method according to claim 1 wherein said acidic agent is carbon dioxide.

6. A method according to claim 5 wherein alkali is added to the alkaline pulping solution during said digestion.

7. A method according to claim 5 wherein said alkaline pulping solution is a solution of sodium hydroxide and sodium sulfide.

8. A method according to claim 5 wherein the initial free hydroxyl ion concentration of said pulping solution is at least 1.25 moles per liter.

* * * * *